United States Patent [19]

Ortega

[11] Patent Number: 5,029,359

[45] Date of Patent: Jul. 9, 1991

[54] PORTABLE VACUUM CLEANER EXHAUST STERILIZATION APPARATUS

[76] Inventor: Louis A. Ortega, 1120 39 St., Brooklyn, N.Y. 11218

[21] Appl. No.: 486,289

[22] Filed: Feb. 28, 1990

[51] Int. Cl.[5] ..... A47L 7/04

[52] U.S. Cl. ..... 15/257 B; 15/344; 15/350; 15/DIG. 1; 55/279

[58] Field of Search ..... 15/257 B, 344, 350, 15/DIG. 1; 55/279

[56] References Cited

U.S. PATENT DOCUMENTS

| | | | |
|---|---|---|---|
| 1,847,233 | 2/1930 | Bilde | 15/257 B |
| 2,304,868 | 12/1942 | Winthrop | 261/121 |
| 2,598,129 | 5/1952 | MacFarland | 21/127 |
| 3,584,330 | 6/1971 | Wallin et al. | 15/375 |
| 4,670,701 | 6/1987 | Sako et al. | 320/2 |

FOREIGN PATENT DOCUMENTS

| | | | |
|---|---|---|---|
| 3740517 | 8/1989 | Fed. Rep. of Germany | 15/257 B |

*Primary Examiner*—Jimmy G. Foster
*Assistant Examiner*—Thomas P. Hilliard
*Attorney, Agent, or Firm*—Leon Gilden

[57] ABSTRACT

Apparatus including an elongate housing containing an intake vacuum nozzle in pneumatic communication with a filtration bag. The filtration bag spaced forwardly of a filtration housing containing a screen grid therewithin. The grid includes a removable plug for directing of fragrance interiorly of the grid. Further, fluid antiseptic and sterilization tubes are receivable within the housing positioned between the filtration housing and the bag and include flexible porous wick bags for directing of the fluid into the exhaust of the vacuum apparatus.

3 Claims, 4 Drawing Sheets

PRIOR ART

PORTABLE VACUUM CLEANER EXHAUST STERILIZATION APPARATUS

BACKGROUND OF THE INVENTION

1. Field of the Invention

The field of the invention relates to vacuum cleaner apparatus, and more particularly pertains to a new and improved portable vacuum cleaner apparatus wherein the same is provided in a coaxially aligned elongate housing including chambers for directing various scented and bacteriological type fluids into the exhaust air stream of the organization.

2. Description of the Prior Art

Vacuum cleaner organizations and portable vacuum cleaner type apparatus has been set forth in the prior art. Heretofore however the prior art has failed to define a streamlined and readily portable organization capable of introducing various and selective fluids particularly of antiseptic and aromatic class into the exhaust air stream preventing spread of undesirable viruses and the like into environments. Examples of the prior art include U.S. Pat. No. 4,225,814 to GANTZ et al utilizing a portable vacuum cleaner organization selectively mounted to a recharging support stand for portable use of the vacuum cleaner.

U.S. Pat. No. 3,267,510 to COTE sets forth a portable vacuum cleaner that utilizes either battery or house current to provide energy for the vacuum cleaner use.

U.S. Pat. No. 4,591,777 to McCARTY et al sets forth a multi-station charging system supporting a variety of appliances such as brushes, vacuums, and the like.

U.S. Pat. No. 3,184,775 to DOWNEY et al sets forth electric carpet sweeper utilizing a cog belt to drive a forwardly mounted brush to direct debris to an intake conduit of the vacuum cleaner apparatus.

U.S. Pat. No. 4,670,701 to SAKO et al sets forth a readily removable vacuum cleaner organization utilizing rechargeable batteries mounted to a recharging support stand for portable use by individuals.

As such, it may be appreciated there continues to be a need for a new and improved portable vacuum cleaner apparatus wherein the same addresses both the problems of ease of use as well as effectiveness in construction and in this respect, the present invention substantially fulfills this need.

SUMMARY OF THE INVENTION

In view of the foregoing disadvantages inherent in the known types of vacuum cleaner apparatus now present in the prior art, the present invention provides an improved portable vacuum cleaner apparatus wherein the same provides an elongate coaxially aligned housing including a plurality of ports for introducing various fluids into the air stream of the vacuum cleaner apparatus. As such, the general purpose of the present invention, which will be described subsequently in greater detail, is to provide a new and improved portable vacuum cleaner apparatus which has all the advantages of the prior art vacuum cleaner apparatus constructions and none of the disadvantages.

To attain this, the portable vacuum cleaner apparatus of the instant invention essentially includes apparatus including an elongate housing containing an intake vacuum nozzle in pneumatic communication with a filtration bag. The filtration bag is spaced forwardly of a filtration housing containing a screen grid therewithin. The grid includes a removable plug for directing of fragrance interiorly of the grid. Further, fluid antiseptic and sterilization tubes are receivable within the housing positioned between the filtration housing and the bag and include flexible porous wick bags for directing of the fluid into the exhaust of the vacuum apparatus.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable vacuum cleaner apparatus which has all the advantages of the prior art vacuum cleaner apparatus and none of the disadvantages.

It is another object of the present invention to provide a new and improved portable vacuum cleaner apparatus which may be easily and efficiently manufactured and marketed.

It is a further object of the present invention to provide a new and improved portable vacuum cleaner apparatus which is of a durable and reliable construction.

An even further object of the present invention is to provide a new and improved portable vacuum cleaner apparatus which is susceptible of a low cost of manufacture with regard to both materials and labor, and which accordingly is then susceptible of low prices of sale to the consuming public, thereby making such portable vacuum cleaner apparatuses economically available to the buying public.

Still yet another object of the present invention is to provide a new and improved portable vacuum cleaner apparatus which provides in the apparatuses and methods of the prior art some of the advantages thereof, while simultaneously overcoming some of the disadvantages normally associated therewith.

Still another object of the present invention is to provide a new and improved portable vacuum cleaner apparatus which may be compactly stored when not being utilized.

Yet another object of the present invention is to provide a new and improved portable vacuum cleaner apparatus wherein the same permits removal and selectively insertable dispersion tubes to direct at various bacteriological combatting fluids into the air stream of the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
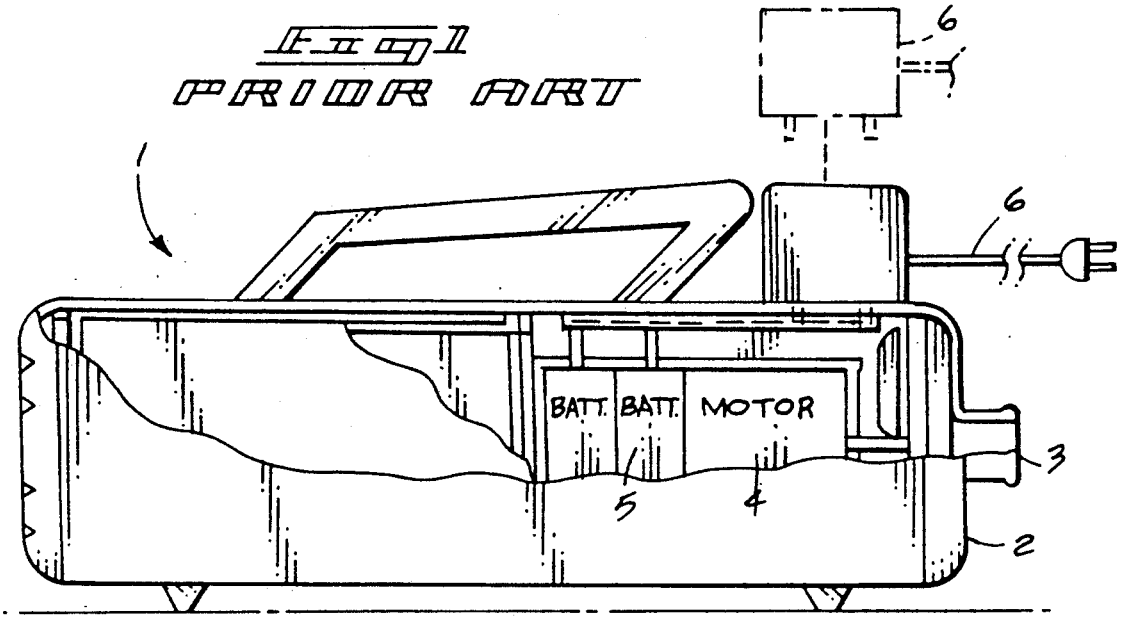
Fig 1 PRIOR ART
FIG. 1 is an orthographic view partially in section of a prior art vacuum cleaner apparatus.

With reference now to the drawings, and in particular to FIGS. 1 to 8 thereof, a new and improved portable vacuum cleaner apparatus embodying the principles and concepts of the present invention and generally designated by the reference numeral 10 will be described.

Figure 2:
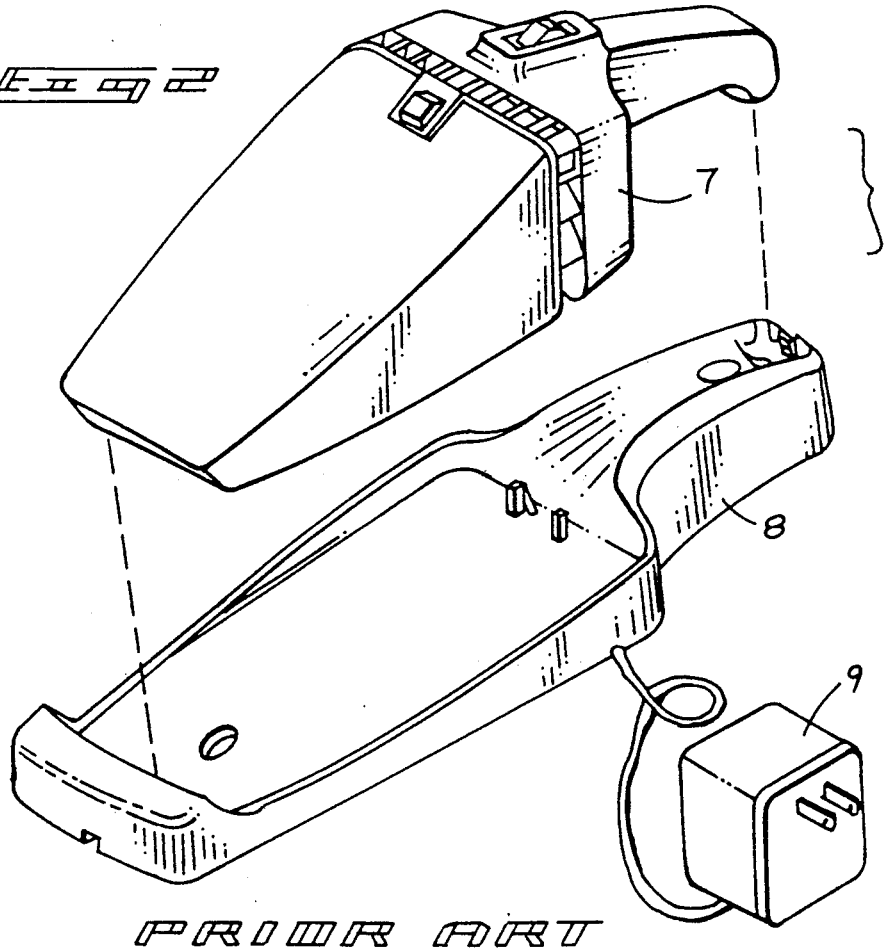
FIG. 2 is an isometric illustration of a prior art vacuum cleaner apparatus.
Figure 3:
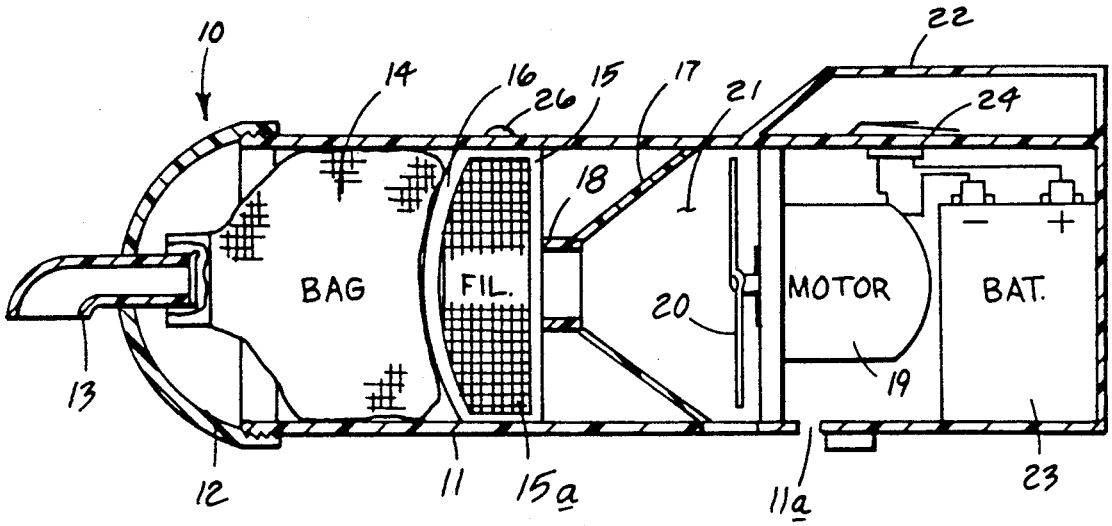
FIG. 3 is an orthographic cross-sectional view of the instant invention.

FIG. 1 is illustrative of a prior art vacuum cleaner apparatus 1 including elongate canister housing 2 containing an inlet conduit 3 with vacuum effected therethrough by a motor 4 operative through batteries 5 or selectively through an alternating current to direct current adapter 6. FIG. 2 illustrates a further prior art vacuum cleaner apparatus member 7 selectively mounted to a recharging plate 8 with adapter 9 to adapt house current to direct current for recharging of the vacuum cleaner 7.

Figure 4:
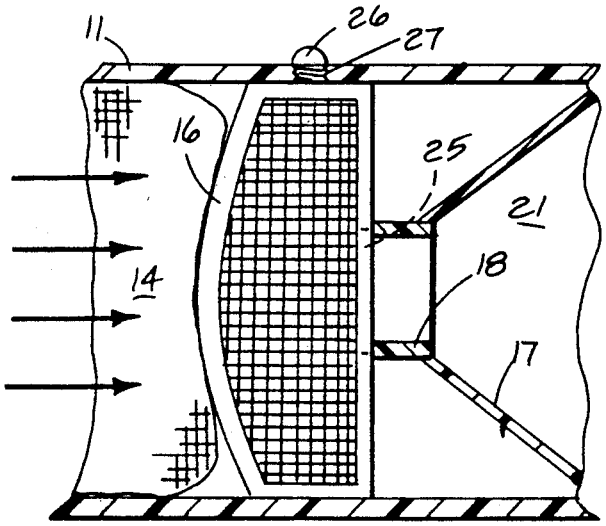
FIG. 4 is an orthographic sectional view taken in cross-section of the filtration housing of the instant invention.

More specifically, the portable vacuum cleaner apparatus 10 essentially comprises a elongate axially aligned cylindrical housing 11 including a threadedly removable hemispherical cap 12 threadedly mounted to a forward end thereof. A vacuum nozzle 13 is coaxially and orthogonally directed through the cap 12 in operative communication with a filtration collection bag 14 formed of a flexible porous construction. The filtration bag 14 is positioned forwardly of a filter housing member 15 including a screen grid 15*a* formed within the housing member 15. The housing member further includes an arcuate forward framework 16 to direct an enlarged rear surface of the filtration bag 14 thereover. A filter housing opening 25 directs a vacuum through the bag 14, the housing 15, and through an input conduit 18 directed into a conical directional housing 17 overlying in surrounding relationship to an impeller 20 rotated by an electric motor 19 to create vacuum within a vacuum chamber 21 defined by the conical directional housing 17. Vacuum directed through the vacuum chamber 21 is exhausted through a predetermined member of exhaust ducts 11*a* formed through the housing 11. A handle 22 is integrally mounted to overly exterior surface of the housing 11 and is axially offset in a parallel relationship relative thereto to overly a switch 24 to electrically and selectively communicate a battery 23 with the electric motor 19. Reference to FIG. 4, illustrates a removable threaded plug 26 receivable within a first threaded fill conduit 27 to enable directing of a fluid into the screen grid 15*a* typically utilizing a scented fluid to minimize offensive odors directed through the exhaust ducts 11*a* from the vacuuming process.

Figure 5:
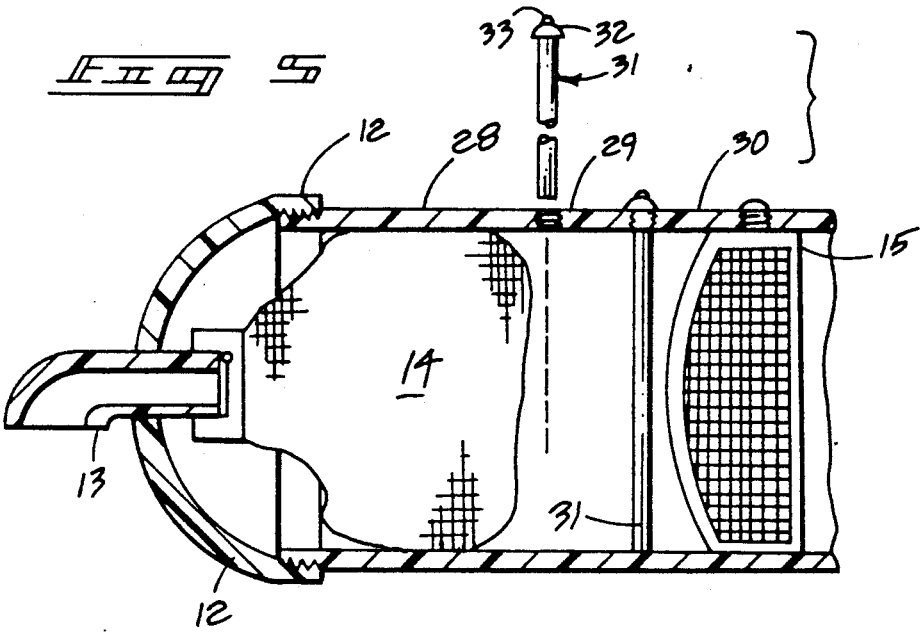
FIG. 5 is an orthographic sectional view taken in cross-section of a modified housing utilized by the instant invention.

Reference to FIG. 5, illustrates a modified housing 28 including threaded bore 29 and 30 respectively to receive respective fluid tubes 31 therethrough. The fluid tubes 31 include a threaded cap 32 threadedly receivable within each of the threaded bores 29 and 30. The fill tubes 31 are hollow and include a threaded fill cap 33 to enable directing of fluids within the tubes 31. Fluids utilized are of an antibacterial compound to sterilize exhaust air directed through the filtration collection bag 14 and minimize spread of various bacteriological dangerous and may be spread in a vacuuming procedure.

Figure 6:
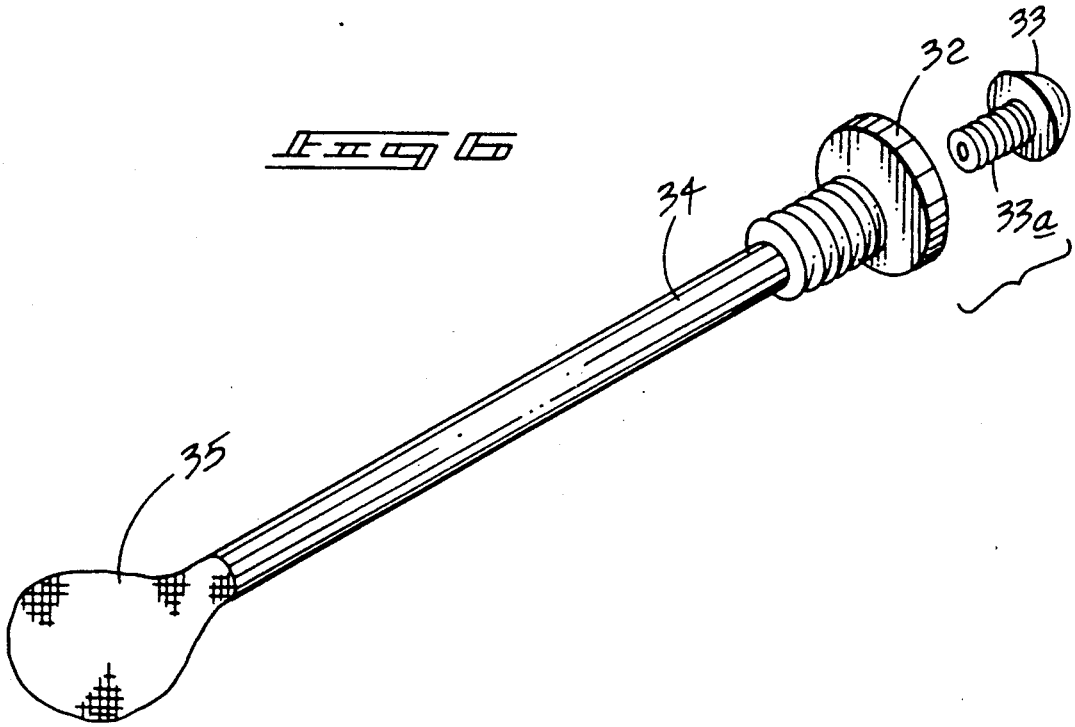
FIG. 6 is an isometric illustration of a fluid tube utilized by the instant invention.
Figure 7:
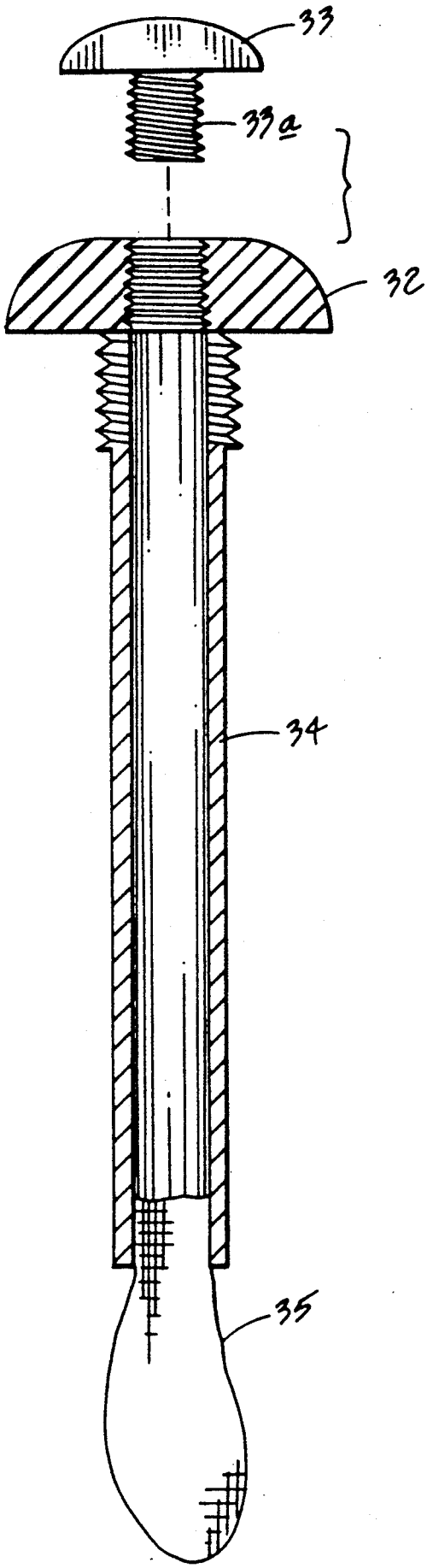
FIG. 7 is an orthographic cross-sectional view of the fluid tube utilized by the instant invention.
Figure 8:
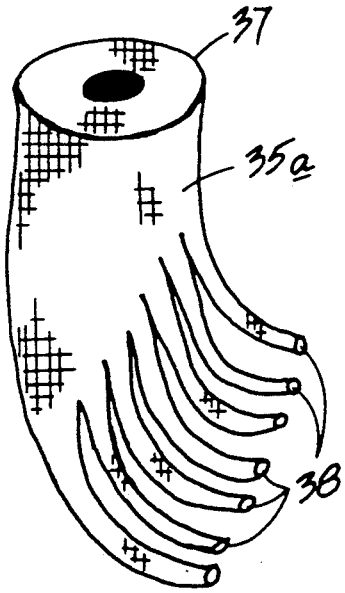
FIG. 8 is an isometric illustration of a modified wick utilized by the fluid tube of the instant invention.

FIGS. 6 and 7 illustrate the threaded caps 32 formed to receive the threaded fill caps 33 that are in turn formed with a threaded shank 33*a*. Upon removal of the threaded fill caps 33, the hollow tubes 34 may be filled with various fluids. FIGS. 6 and 7 illustrate the hollow tubes including a flexible porous wick bag 35 mounted to a lower terminal end thereof wherein air directed past the wick bags 35 will direct fluid from within the tubes 34 into the air stream. A modified wick bag 35*a* as illustrated in FIG. 8 including an opening 37 for securement about an exterior of the hollow tubes 34 at a lower terminal end thereof that include a series of capillary tubes 38 directed downwardly and flexibly from the modified wick bag 35*a* and from its internal cavity to assist in directing a germicidal type fluid into the air stream directed thereby wherein the vibratory action imparted to the capillary tubes 38 enhances the dispersion of fluid.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable vacuum cleaner apparatus comprising in combination, an elongate axially aligned housing including a removable cap mounted on a forward end thereof, and a vacuum nozzle directed coaxially through the cap, the vacuum nozzle including a filtration collection bag mounted to a rear end of the nozzle interiorly of the housing, and a filter housing member coaxially mounted within the housing rearwardly of the filtration collection bag, and a motor mounted coaxially of the housing and rearwardly of the filter housing member including an impeller mounted to the motor to create vacuum rearwardly of the filter housing member and direct vacuum through the filtration collection bag, through the filter housing member, and exhausting the vacuum created through exhaust ducts formed through the housing, and wherein the filter housing member includes a rear wall, and a filter housing opening directed through the rear wall, and an input conduit directed and coaxially aligned with the filter housing opening, and the input conduit integrally mounted to a conical directional housing mounted to an interior surface of the elongate axially aligned housing between the filter housing member and the impeller to create a vacuum chamber between the impeller and the filter housing member, and further including a battery mounted rearwardly of the motor within the housing, and a switch means mounted in the housing wall for effecting selective electrical communication of the battery with the motor, and a handle mounted to the housing overlying the switch, and wherein the cap is threadedly mounted to the housing to enable removal and replacement of the filtration collection bag, and including a fill conduit overlying the filter housing member, the filter housing member including a screen grid formed throughout an interior of the filter housing member, and the fill conduit including a plug member threadedly removable from the fill conduit for directing fluid throughout the screen grid, and further including a first and second threaded bore orthogonally mounted through the cylindrical housing and each threaded bore including a first and second fluid tube receivable through the respective first and second threaded bore, each fill tube including a threaded cap threadedly securable to each threaded bore, and each fill tube including apertures therethrough to direct fluid from within each tube into the vacuum created by the impeller, and wherein each fill tube includes a flexible porous wick bag secured to each lower terminal end of each fill tube to direct fluid through each wick bag into the vacuum.

2. Apparatus set forth in claim 1 wherein each fill tube includes a threaded plug mounted into each threaded cap, each threaded plug threadedly receivable within a threaded bore through each cap wherein each threaded bore is in fluid communication with each cavity of each fill tube.

3. Apparatus set forth in claim 2 wherein each porous bag includes a series of flexible capillary tubes directed downwardly from each bag and each fill tube is securable to a lower terminal end of each fill tube.

* * * * *